US010959481B2

(12) United States Patent
Gruben et al.

(10) Patent No.: US 10,959,481 B2
(45) Date of Patent: Mar. 30, 2021

(54) FOOTWEAR APPARATUS WITH REMOVABLE POWER SUPPLY

(71) Applicant: Zero Point Energy Inc., Los Angeles, CA (US)

(72) Inventors: Jacob Yasha Gruben, New York, NY (US); Maral Kalinian, San Juan Capistrano, CA (US)

(73) Assignee: Zero Point Energy Inc., Los Angeles, CA (US)

( * ) Notice: Subject to any disclaimer, the term of this patent is extended or adjusted under 35 U.S.C. 154(b) by 33 days.

(21) Appl. No.: 16/244,040

(22) Filed: Jan. 9, 2019

(65) Prior Publication Data

US 2020/0214384 A1 Jul. 9, 2020

(51) Int. Cl.
*A43B 3/00* (2006.01)
*A43B 13/14* (2006.01)

(52) U.S. Cl.
CPC ..... *A43B 3/0015* (2013.01); *A43B 3/001* (2013.01); *A43B 13/14* (2013.01)

(58) Field of Classification Search
CPC ..... A43B 3/0015; A43B 3/001; A43B 13/14
See application file for complete search history.

(56) References Cited

U.S. PATENT DOCUMENTS 4,327,153 A 4/1982 Micheron
5,245,734 A 9/1993 Issartel
5,373,651 A 12/1994 Wood
8,203,829 B2 * 6/2012 Yuan ..... G06F 1/1626 361/679.01
8,970,054 B2 3/2015 Stanton et al.
(Continued)

FOREIGN PATENT DOCUMENTS

CN 101666860 * 3/2010
CN 201948063 8/2011
(Continued)

OTHER PUBLICATIONS

Lavars, Nick, "Kinetic Energy-Harvesting Shoes a Step Towards Charging Mobile Devices on the Go," https://newatlas.com/energy-harvesting-shoes/41796/, Feb. 11, 2016.
(Continued)

*Primary Examiner* — Richard V Muralidar
(74) *Attorney, Agent, or Firm* — Patent Ingenuity, P.C.; Samuel K. Simpson

(57) ABSTRACT

A footwear apparatus has a bottom portion on which a foot of a user is positioned. The bottom portion has a heel portion and a toe portion. Further, the footwear apparatus has a rear portion operably attached to the heel portion. Additionally, the footwear apparatus has a force-to-energy conversion device that is operably attached to the heel portion in proximity to the rear portion. The force-to-energy conversion device receives one or more external forces from an environment external to the shoe. Further, the force-to-energy conversion device converts the one or more external forces to electrical energy. Moreover, the footwear apparatus has a removable power supply assembly that is operably connected to the rear portion. The removable power supply assembly has a power supply that stores the electrical energy.

19 Claims, 16 Drawing Sheets

(56) References Cited

U.S. PATENT DOCUMENTS

| | | | | |
|---|---|---|---|---|
| 9,179,734 | B2 * | 11/2015 | Zsolcsak | A43B 17/00 |
| 9,385,351 | B2 * | 7/2016 | Workman | H01M 2/204 |
| 2004/0046673 | A1 * | 3/2004 | Kovarik | G01R 31/388 340/636.1 |
| 2006/0021261 | A1 | 2/2006 | Face | |
| 2007/0044346 | A1 * | 3/2007 | Ungari | A43B 3/24 36/136 |
| 2008/0083139 | A1 | 4/2008 | Mullen | |
| 2013/0247424 | A1 * | 9/2013 | Tseng | A43B 3/0005 36/136 |
| 2014/0082963 | A1 * | 3/2014 | Beers | A43B 11/00 36/83 |
| 2015/0289595 | A1 * | 10/2015 | Rushbrook | A43C 1/06 36/50.1 |
| 2016/0067584 | A1 * | 3/2016 | Giedwoyn | A61B 5/112 700/91 |
| 2017/0001721 | A1 | 1/2017 | Saika et al. | |
| 2017/0164680 | A1 * | 6/2017 | Ge | H02J 7/32 |
| 2017/0208159 | A1 * | 7/2017 | Romain | H04M 1/0262 |
| 2019/0216162 | A1 * | 7/2019 | Gruben | A43B 13/14 |

FOREIGN PATENT DOCUMENTS

| | | | | |
|---|---|---|---|---|
| CN | 105533905 | | 5/2016 | |
| FR | 2745476 | A1 * | 9/1997 | H02N 2/18 |
| KR | 20110049293 | | 5/2011 | |
| KR | 20130112082 | | 10/2013 | |

OTHER PUBLICATIONS

Hsu, Tsung-Hsing, et al., "Bubbler: A Novel Ultra-High Power Density Energy Harvesting Method Based on Reverse Electrowetting," https://www.nature.com/articles/srep16537, Nov. 16, 2015.

* cited by examiner

FOOTWEAR APPARATUS WITH REMOVABLE POWER SUPPLY

BACKGROUND

1. Field

This disclosure generally relates to footwear. More particularly, the disclosure relates to footwear with a power supply.

2. General Background

Recent developments in technology have led to an increased usage of various electronics devices (e.g., smartphones, tablet devices, smartwatches, etc.); along with such increased usage has come an increased demand for electricity to power those electronic devices. For example, a typical smartphone user may expend a significant amount of electrical power via various activities performed by a smartphone (e.g., software applications, phone calls, text messages, video downloads, etc.). As a result, many smartphones users typically drain the power supply (e.g., battery) integrated into their various electronics devices on a regular basis.

Subsequent to such battery drainage, electronics device users are often left trying to find a power supply source to keep their electronics devices operational. Given the mobility of many current electronics devices (e.g., smartphones), finding a conventional power source (e.g., a wall outlet) is often inconvenient and cumbersome for the mobile user. As a result, typical power supply configurations do not provide electrical power to mobile electronics devices in a timely, convenient manner.

SUMMARY

In one embodiment, a footwear apparatus has a bottom portion on which a foot of a user is positioned. The bottom portion has a heel portion and a toe portion. Further, the footwear apparatus has a rear portion operably attached to the heel portion.

Additionally, the footwear apparatus has a force-to-energy conversion device that is operably attached to the heel portion in proximity to the rear portion. The force-to-energy conversion device receives one or more external forces from an environment external to the shoe. Further, the force-to-energy conversion device converts the one or more external forces to electrical energy.

Moreover, the footwear apparatus has a removable power supply assembly that is operably connected to the rear portion. The removable power supply assembly has a power supply that stores the electrical energy.

In another embodiment, the footwear apparatus has a primary force-to-energy conversion device and a secondary force-to-energy conversion device. The primary force-to-energy conversion device is operably attached to the heel portion in proximity to the rear portion. Further, the primary force-to-energy conversion device receives one or more first external forces from an environment external to the heel portion. The primary force-to-energy conversion device converts the one or more first external forces to first electrical energy. Moreover, the footwear apparatus has a removable power supply assembly that is operably connected to the rear portion, and that has a power supply that stores the first electrical energy.

Further, the secondary force-to-energy conversion device is operably attached to the toe portion. The secondary force-to-energy conversion device receives one or more second external forces from an environment external to the toe portion. Moreover, the secondary force-to-energy conversion device converts the one or more second external forces to second electrical energy. Additionally, the footwear apparatus has an internal power supply operably attached to the bottom portion. The internal power supply stores the second electrical energy.

BRIEF DESCRIPTION OF THE DRAWINGS

The above-mentioned features of the present disclosure will become more apparent with reference to the following description taken in conjunction with the accompanying drawings wherein like reference numerals denote like elements and in which.

DETAILED DESCRIPTION

A footwear apparatus is provided to convert various types of forces into electrical energy. For instance, the footwear apparatus may convert mechanical forces exerted on the footwear via various activities (e.g., running, walking, etc.) into electrical energy. Further, the footwear apparatus has a removable power supply (e.g., battery) that may store the electrical energy. Moreover, the footwear apparatus may have a power supply indicator positioned thereon that displays a power supply level. A user may remove the removable power supply and operably connect it to an electronics device to recharge a power supply positioned within the electronics device.

The footwear apparatus may be implemented as, or integrated in, various forms of footwear (e.g., shoe, sneaker, boot, slipper, sandal, etc.). Further, the footwear apparatus may be configured, via an optimal arrangement of internal componentry, to provide comfort for performing the aforementioned activities; additionally, such an optimal arrangement of componentry allows for a wide variety of footwear apparatus sizes—even children's sizes.

Figure 1A:
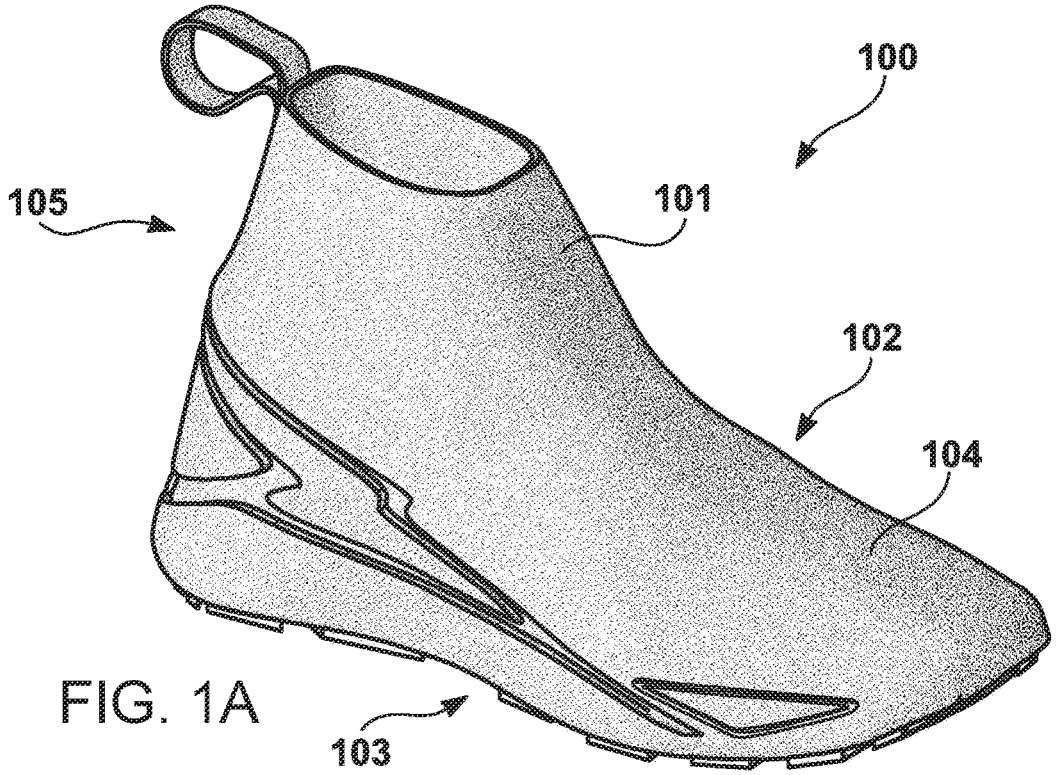
FIG. 1A illustrates a front perspective view of a footwear apparatus.
Figure 1B:
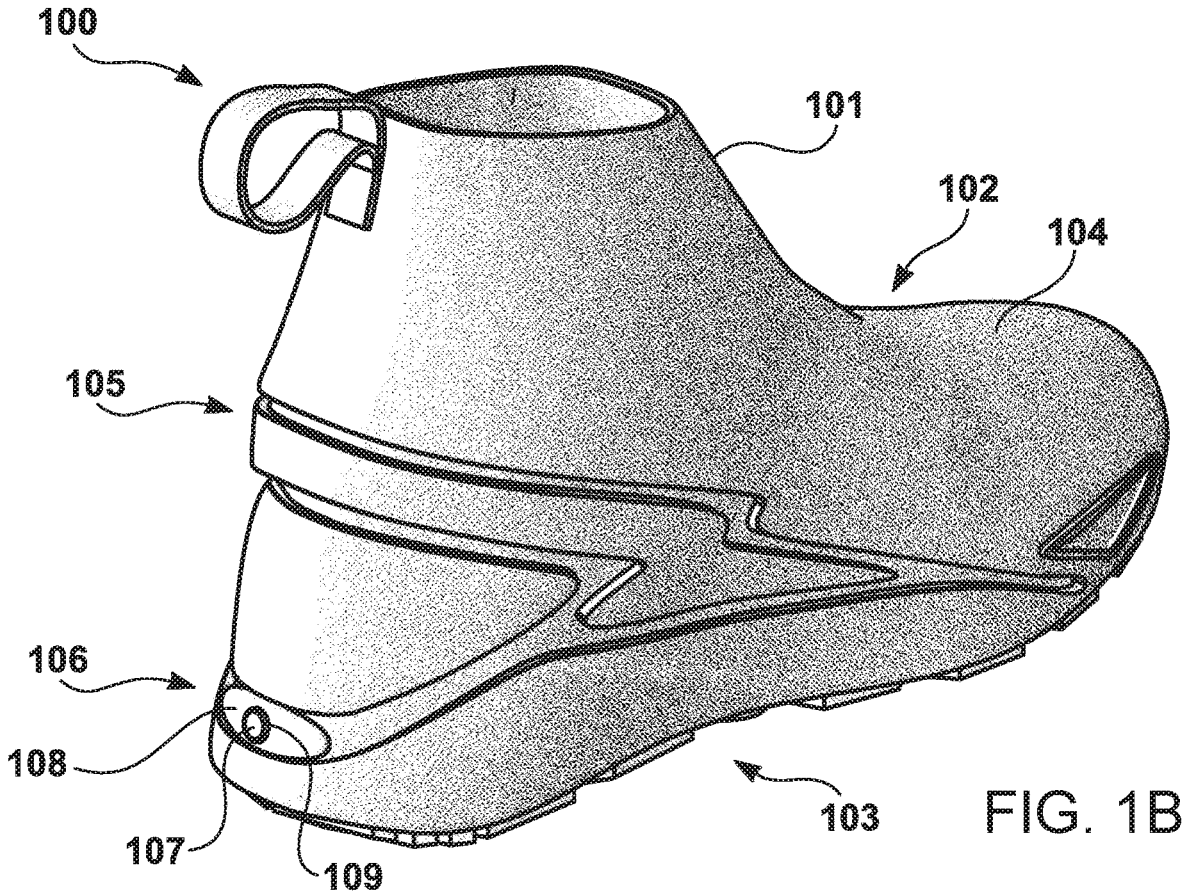
FIG. 1B illustrates a rear perspective view of the footwear apparatus.

FIGS. 1A and 1B illustrate a top perspective view and a rear perspective view, respectively, of a footwear apparatus 100. As an example, a shoe 101 is illustrated as having a top portion 102 and a bottom portion 103. The top portion 101 includes an instep 104 (where laces, zippers, velcro, etc. may or may not be positioned) and rear portion 105. The back of a user's heel may be placed in proximity to the inside of the rear portion 105. As an example, the shoe 101 may be a sock shoe that has a sock configuration for the top portion 102 and sole configuration for the bottom portion 103. Alternatively, various other types of shoe configurations may be integrated in, or attached to, the footwear apparatus 100.

As illustrated in FIG. 1B, a removable power supply assembly 106 may be operably attached, or integrated within, the rear portion 105. For example, the removable power supply assembly 106 may be a battery compartment. Further, the removable power supply assembly 106 may include an exterior actuator 107 (e.g., button, knob, lever, etc.), which may be actuated to remove the removable power supply assembly 106 from the shoe 101.

In one embodiment, the exterior actuator 107 may be integrated within connection member 108 that connects the removable power supply assembly 106 to the shoe 101. For example, the connection member 108 may be a lip mechanism fabricated from one or more materials (e.g., silicone, plastic, rubber, etc.) that surrounds the exterior actuator 107 and acts as a sealant between the removable power supply assembly 106 and the rear portion 105 to minimize exposure to environmental conditions (e.g., rain, snow, etc.). In other words, the connection member 108 may prevent environmental exposure to internal components of the removable power supply assembly 106 stored within the shoe 101, thereby preserving any accumulated electrical charge and providing safety to the user of the footwear apparatus 100. In an alternative embodiment, the exterior actuator 107 directly performs the functionalities of the connection member 108 without the need for the connection member 108.

Further, a power supply indicator 109 may be integrated with, or operably attached to, the rear portion 105. The power supply indicator 109 allows a user to determine the amount of electrical charge stored in the removable power supply assembly 106. For example, if the power supply indicator 109 indicates little, or no, stored electrical charge, the user of the footwear apparatus 100 may wait to remove the removable power supply assembly 106, from the footwear apparatus 100, until more activity (e.g., running, walking, etc.) is performed with the footwear apparatus 100 to generate a significant amount of electrical charge for storage in the removable power supply assembly 106.

In one embodiment, the power supply indicator 109 is situated on the exterior of the removable power supply assembly 106. For example, one or more light emitting diodes ("LEDs") may be used as the power supply indicator 109, and may form a ring around the exterior actuator 107. (A variety of other types of visual indicators may be used in the alternative, or in addition, to LEDs.) Accordingly, the power supply indicator 109 may be removed from the shoe 101 along with the removable power supply assembly 106 upon ejection via the exterior actuator 107. In another embodiment, the power supply indicator 109 is situated on the rear portion 105, but in a position that is distinct from the exterior actuator 107 (e.g., above the exterior actuator 107). In other words, the power supply indicator 109 may remain connected to the shoe 101 upon ejection of the removable power supply assembly 106 via the exterior actuator 107. In yet another embodiment, the power supply indicator 109 is not positioned on the footwear apparatus 100, but rather is a display feature of a software application operated by an external electronics device (e.g., smartphone) that receives the power supply data from the footwear apparatus 100 via wireless transmission.

In another embodiment, the power supply indicator 109 is an audio component (e.g., speaker, amplifier, etc.) that emits an audio output (e.g., audio pulses, computer-generated voice indication, etc.) based on the power supply level. For example, the footwear apparatus 100 may have one or more built-in audio speakers that emit the audio output. As another example, an external electronics device (e.g., smartphone) may receive the power supply data from the footwear apparatus 100, via a wireless transmission, and emit the audio output. In yet another embodiment, the power supply indicator 109 is a haptic vibration unit positioned in the footwear apparatus 100 that emits vibration-based outputs (e.g., vibration pulses) according to the power supply level. Alternatively, an external electronics device may receive the power supply data from the footwear apparatus 100, via a wireless transmission, and emit the haptic output. (Various other types of outputs, and/or combinations of the outputs described herein, may be used instead).

Figure 1C:
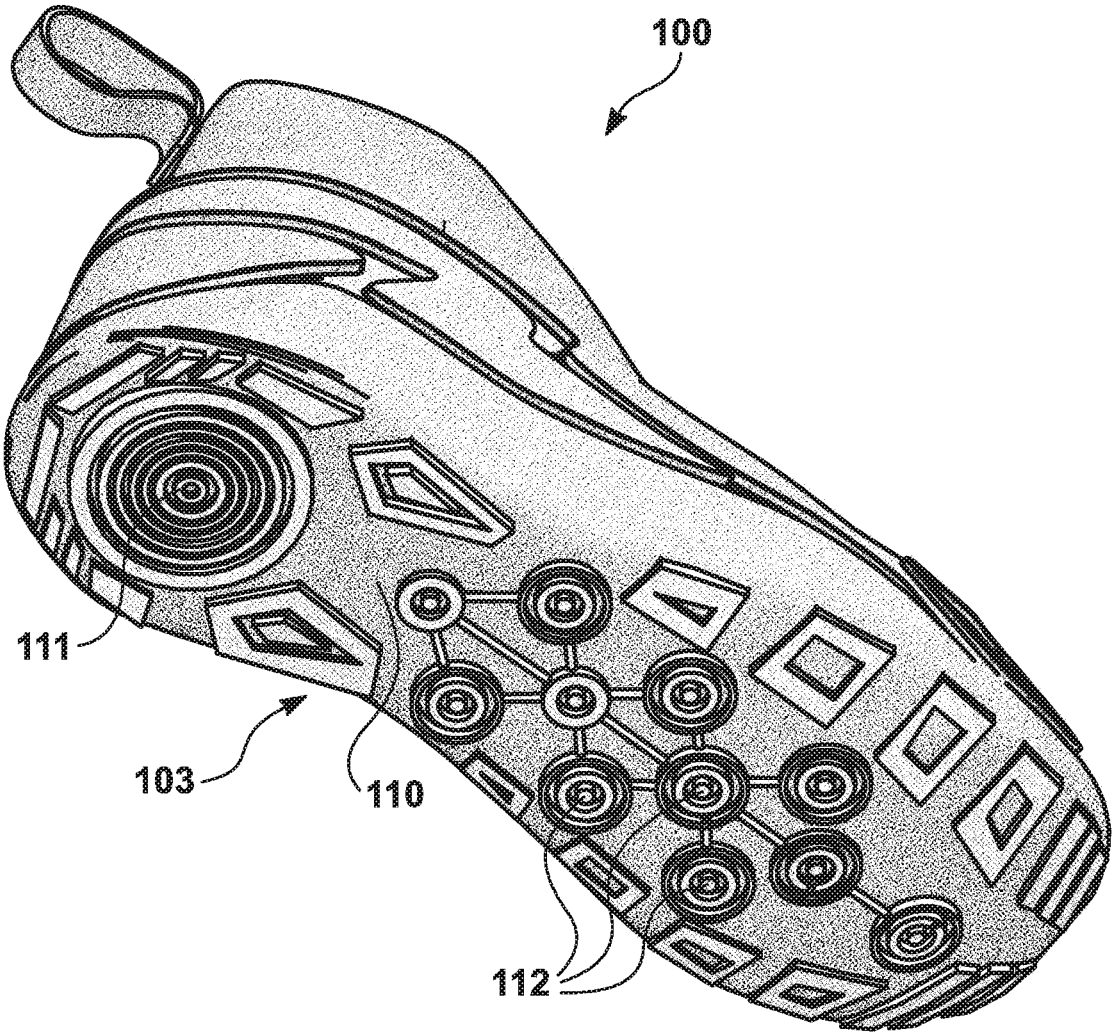
FIG. 1C illustrates a bottom perspective view of the footwear apparatus illustrated in FIGS. 1A and 1B.

Further, FIG. 1C illustrates a bottom perspective view of the footwear apparatus 100 illustrated in FIGS. 1A and 1B. In one embodiment, a rear elevation member 111 is operably attached to, or integrated within, a rear portion of an outsole 110. The rear elevation member 111 elevates the footwear apparatus 100 to amplify/accentuate one more vibrations that result from impact between the heel of the footwear apparatus 100 and a contact surface (e.g., the ground). (One rear elevation member 111 is illustrated in FIG. 1C only as an example as multiple rear elevation members 111 may elevate the heel.) In another embodiment, one or more toe elevation members 112 may be operably attached to a front, toe portion of the outsole 110 to amplify/accentuate one more vibrations that result from impact between the toe portion of the footwear apparatus 100 and a contact surface. (The toe portion is intended herein to refer to the section of the bottom portion 103 that rests underneath the toes and/or balls of the feet of the wearer of the shoe 101.)

Figure 2A:
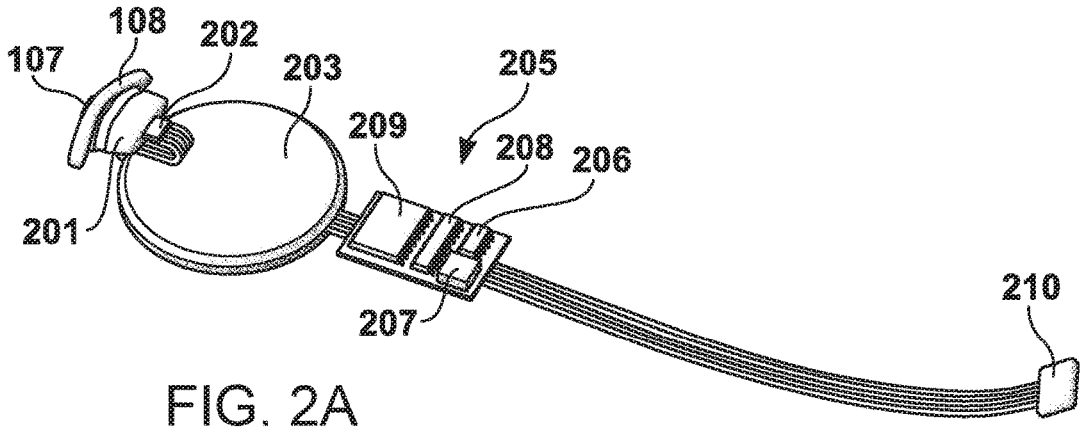
FIG. 2A illustrates a side perspective view of the internal components of the bottom portion of the shoe illustrated in FIG. 1.
Figure 2B:
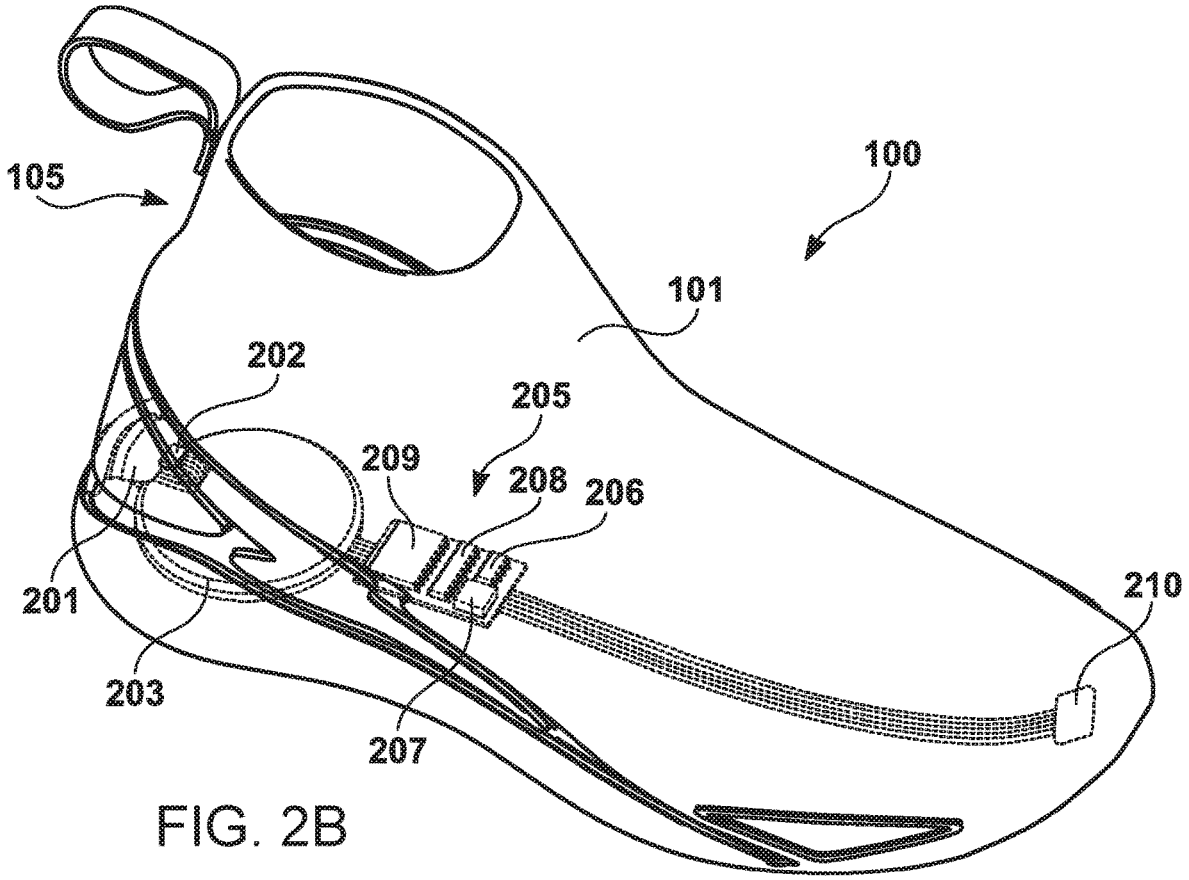
FIG. 2B illustrates the internal components positioned within the bottom portion of the shoe.

FIG. 2A illustrates a side perspective view of the internal components of the bottom portion 103 removed from the shoe 101, whereas FIG. 2B illustrates the internal components positioned within the bottom portion 103 of the shoe 101. The internal components may be used to convert the forces generated from impact with the footwear apparatus 100 into electrical energy for storage by the removable power supply assembly 106.

The internal portion of the removable power supply assembly 106 is illustrated as having a rechargeable power supply 201 (e.g., lithium ion battery, water-based battery, etc.). Further, the rechargeable power supply 201 is connected via a power supply connector 202 (e.g., USB device, cable, etc.) to a primary force-to-energy converter 203. Given that the majority of forces generated by user of footwear often occur in the heel portion, the primary force-to-energy converter 203 is optimally positioned toward the rear of the bottom portion 103 (i.e., substantially above the rear elevation member 111). Further, the rechargeable power supply 201 is optimally positioned in the rear portion 103 to be in proximity to the primary force-to-energy converter 203 for efficient delivery of electrical charge to the rechargeable power supply 201 for storage by the rechargeable power supply 201.

For instance, the primary force-to-energy converter 203 may absorb the force exerted on the footwear apparatus 100 (e.g., via the rear elevation member 111) and convert the mechanical forces (e.g., compression, flexion, shock, etc.) into electrical energy. As an example, the primary force-to-energy converter 203 may be a piezoelectric assembly, having one or more materials (e.g., various crystals, ceramics, etc.), which have the property of accumulating electric charge as a result of application of mechanical forces (e.g., direct impact applied to the footwear apparatus 100 and/or vibrations of the footwear apparatus 100 resulting from indirect movement such as body movement, swinging of a limb, etc.). As another example, the primary force-to-energy converter 203 may be a bubbler, which includes a movable upper plate that moves via pressurized gas with respect to a lower plate to generate electrical charge. As yet another example, the primary force-to-energy converter 203 may be a turbine system that generates electrical charge via a turbine spinning as a result of applied pressure. Accordingly, the primary force-to-energy converter 203 is not limited to a particular device, and may even include a combination of force-to-energy devices (e.g., one or more piezoelectric devices positioned on top of, and/or under, a turbine system).

Moreover, various additional components may be utilized to harvest, transform, and/or multiple the energy generated by the primary force-to-energy converter 203 for storage by the rechargeable power supply 201. For example, a capacitor may be utilized to temporarily store the electrical charge accumulated by the primary force-to-energy converter 203 until a predetermined amount of electrical charge has been accumulated, at which point the accumulated electrical charge is delivered to the rechargeable power supply 201. As another example, a rectifier may be utilized to convert alternating current ("AC") generated by the force-to-energy converter 203 to direct current ("DC") prior to storage by the rechargeable power supply 201. As yet another example, a transformer may be used to transfer electrical energy from the primary force-to-energy converter 203 to the rechargeable power supply 201. As another example, an amplifier is utilized to amplify the electrical energy generated by the force-to-energy converter 203.

In one embodiment, the primary force-to-energy converter 203 may be utilized by the footwear apparatus 100 without any additional force-to-energy converters 203. For example, in addition to generating energy for storage by the rechargeable power supply 201, the primary force-to-energy converter 203 may also provide electricity to an internal control system 205 that is positioned on a control board 206 (e.g., motherboard). The control system 205 may have one or more processors 207 that may perform a variety of functions via the footwear apparatus 100, such as energy management, adjustment of the power supply indicator 109, communication between internal components of the footwear apparatus 100, communication between an internal component of the footwear apparatus 100 and an external device, etc.

Additionally, other components may be positioned on the control board 206, or in proximity to control system 205. As an example, a transceiver 208 may be positioned on the control board 206 for operable communication with the processor 207. The transceiver 208 allows the processor 207 to send/receive one or more messages (e.g., via wireless communication) to and/or from an external computing device, such as a smartphone. As another example, the control board 206 may have a rechargeable internal power supply 209 that provides power for the control system 205. For example, the rechargeable power supply 201 may provide electrical power to the rechargeable internal power supply 209, in addition to storing electrical charge for use with an external electronics device. Other components (e.g., memory device, GPS device, etc.) may also be positioned on the control board 206 for communication with the processor 207.

As another example, one or more motion sensors 210 may be positioned in various locations (e.g., front of bottom portion 103, sides of bottom portion 103, rear of bottom portion 103, etc.) throughout the footwear apparatus 100 to detect motion of the footwear apparatus 100. The one or more motion sensors 210 may then provide the tracked motion data to the processor 207, which may perform various functions on the sensed data. For example, in one embodiment, the processor 207 may analyze the sensed data to determine footstep patterns, speed, intensity, etc. Rather than expending computing resources, and battery power, at an external computing device, the footwear apparatus 100 may analyze the data and transmit the analysis to the external electronics device (e.g., a smartphone using a fitness-based software application). As another example, in another embodiment, the processor 207 may transmit the sensed data, with no, or only partial, analysis, to the external electronics device.

The positioning of various sensors (e.g., motion sensor 210) throughout the footwear apparatus 100 improves the accuracy of data that is sensed and/or analyzed via the footwear apparatus 100 and/or one or more external electronics devices. For example, the motion sensor 210 is more often closely positioned to the area of force generation (i.e., the footwear apparatus 100) than an external electronics device, which is most often positioned at a significant distance (e.g., pocket, arm band, hand, etc.) from the area of force generation. Accordingly, the arrangement of the specific componentry within the footwear apparatus 100 allows for an improvement in the accuracy of the data that is sensed and/or analyzed.

Figure 2C:
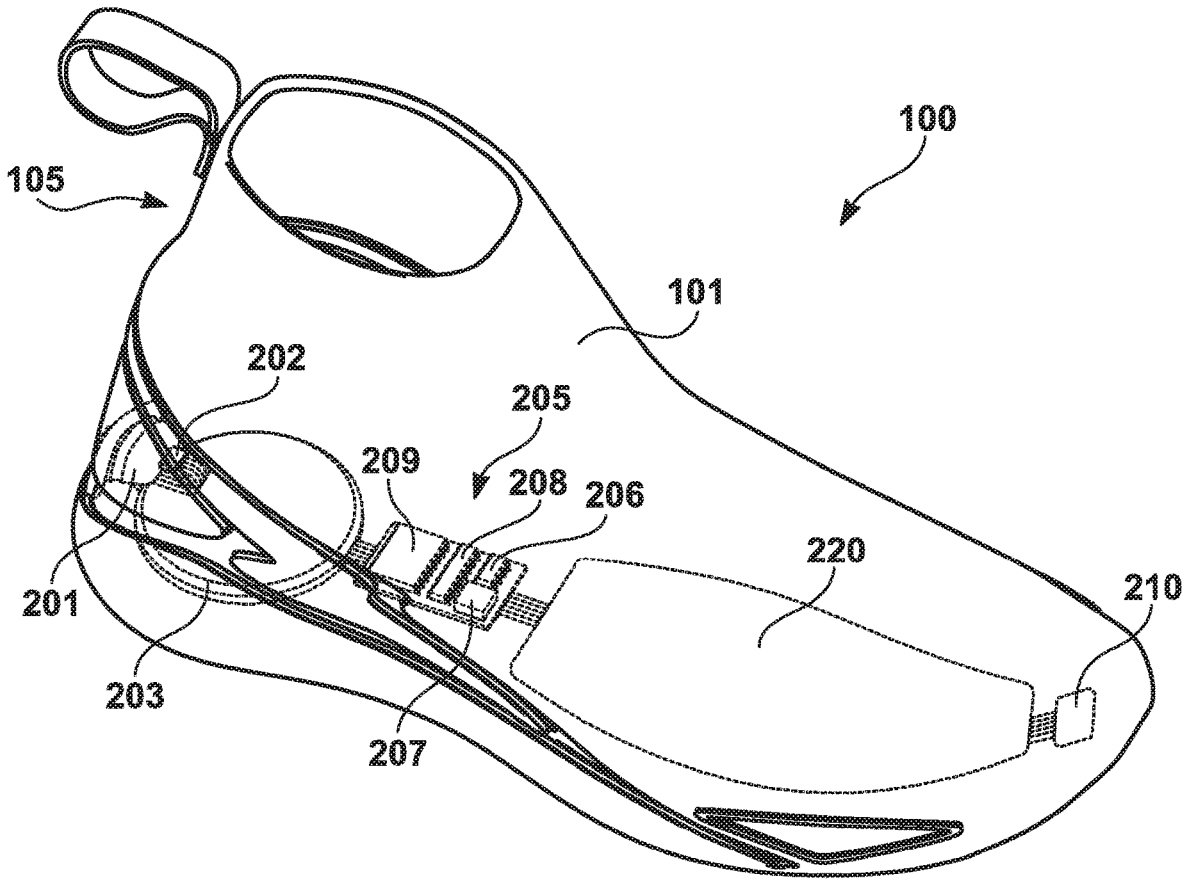
FIG. 2C illustrates a side perspective view of the internal components of the bottom portion of the shoe illustrated in FIG. 1, but with a secondary force-to-energy converter that generates electrical power for an internal rechargeable power supply.

In an alternative embodiment, the primary force-to-energy converter 203 is utilized by the footwear apparatus 100 with one or more additional force-to-energy converters 203. FIG. 2C illustrates a side perspective view of the internal components of the bottom portion of the shoe 101 illustrated in FIG. 1, but with a secondary force-to-energy converter 220 that generates electrical power for an internal rechargeable power supply 209.

Rather than diverting energy generated by the primary force-to-energy converter 203 to provide electrical charge to both the removable power supply assembly 106 and the internal control system 205, the footwear apparatus 100 allows the primary force-to-energy converter 203 to allocate all, or a substantial amount, of its harvested energy for storage by the removable power supply assembly 106 given that the secondary force-to-energy converter 220 generates electrical power for the internal rechargeable power supply 209, which powers the internal control system 205. In other words, the force-to-energy converter that generates electricity from the position of maximum force (i.e., the heel) powers the removable, rechargeable power supply 201; whereas the converter that generates electricity from the position of lesser force (i.e., the toe area) powers the internal rechargeable power supply 209.

In one embodiment, given that the amount of electricity necessary to power the internal control system 205 may be relatively low compared to the amount of electricity necessary to recharge a power supply for an external electronics device (e.g., smartphone), some of the electrical charge generated by the secondary force-to-energy converter 220 may be delivered to the removable, rechargeable power supply 201 in addition to the electrical charge delivered from the primary force-to-energy converter 203. Accordingly, the primary force-to-energy converter 203 and/or the secondary force-to-energy converter 220 may be used to generate electrical charge for the removable, rechargeable power supply 201.

The primary force-to-energy converter 203 and the secondary force-to-energy converter 220 may be the same, or different, types of converters. For example, both the primary force-to-energy converter 203 and the secondary force-to-energy converter 220 may be piezoelectric devices. As another example, the primary force-to-energy converter 203 may be a bubbler, whereas the secondary force-to-energy converter 220 may be a piezoelectric device.

In one embodiment, the rear elevation member 111 and/or toe elevation members 112 illustrated in FIG. 1C, which may be manufactured from a plurality of materials (e.g., rubber), may increase the amount of energy generated by the primary force-to-energy converter 203 and/or the secondary force-to-energy converter 220.

Figure 2D:
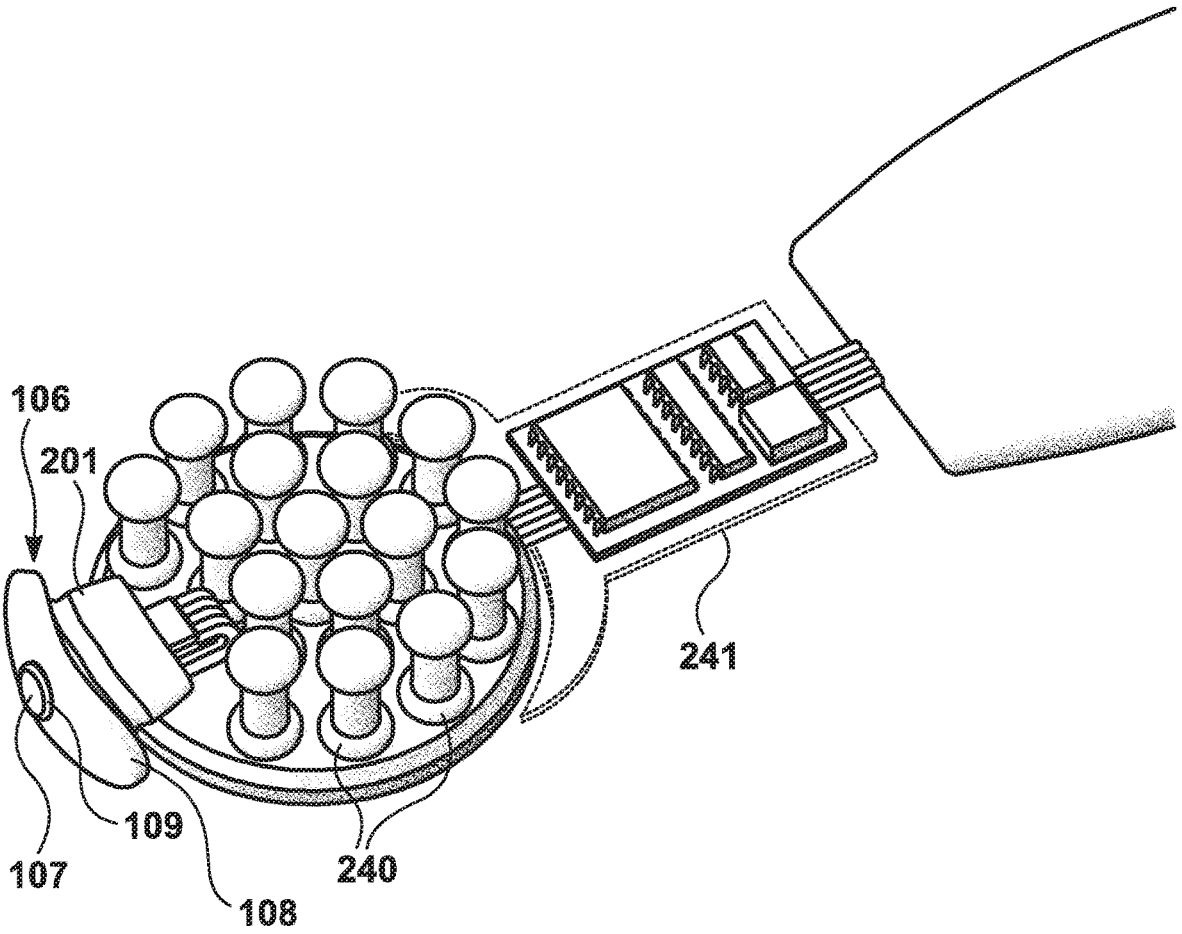
FIG. 2D illustrates one or more protective layers that are integrated within the bottom portion of the shoe to protect various internal componentry.

Further, in one embodiment, as illustrated in FIG. 2D, one or more protective layers are integrated within the bottom portion 103 of the shoe 101 to protect various internal componentry. For example, the control board 206, or other internal components, may be positioned on a bottom layer 241 (e.g., metal shank) to avoid damage to the internal control system 205 during the exertion of forces (walking, running, compression, flexion, etc.) on the bottom portion 103 of the shoe 101; moreover, an upper layer (e.g., carbon fiber) may be positioned over the control board 206 to provide an added layer of protection during such activities. The one or more protective layers, in addition to the corresponding control board 206, may be optimally positioned between the rear portion and the middle portion of the bottom portion 103 of the shoe 101 to allow for flexion toward the front portion of the bottom portion 103 (e.g., in proximity to the area that receives one or more toes of the user).

Moreover, one or more support members 240 (e.g., rubber pillars, layers, etc.) may be used to protect the removable power supply assembly 106, and/or associated circuity and connectors, from pressure exerted by foot placement of a user and/or force generation, thereby alleviating, or minimizing, damage to the internal componentry.

Figure 3A:
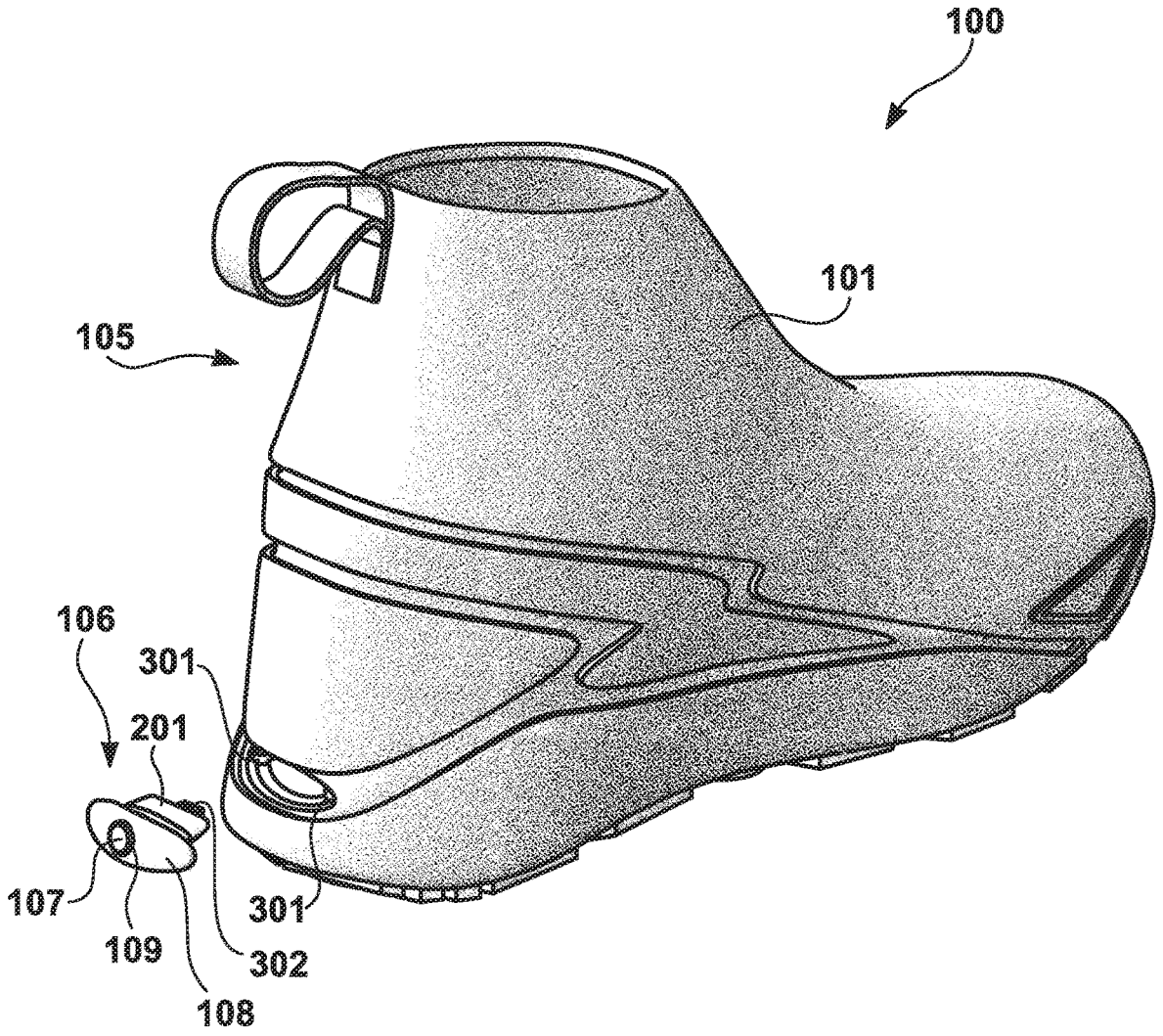
FIG. 3A illustrates an example of the internal removal system for removing the removable power supply assembly illustrated in FIGS. 1A-2B.
Figure 3B:
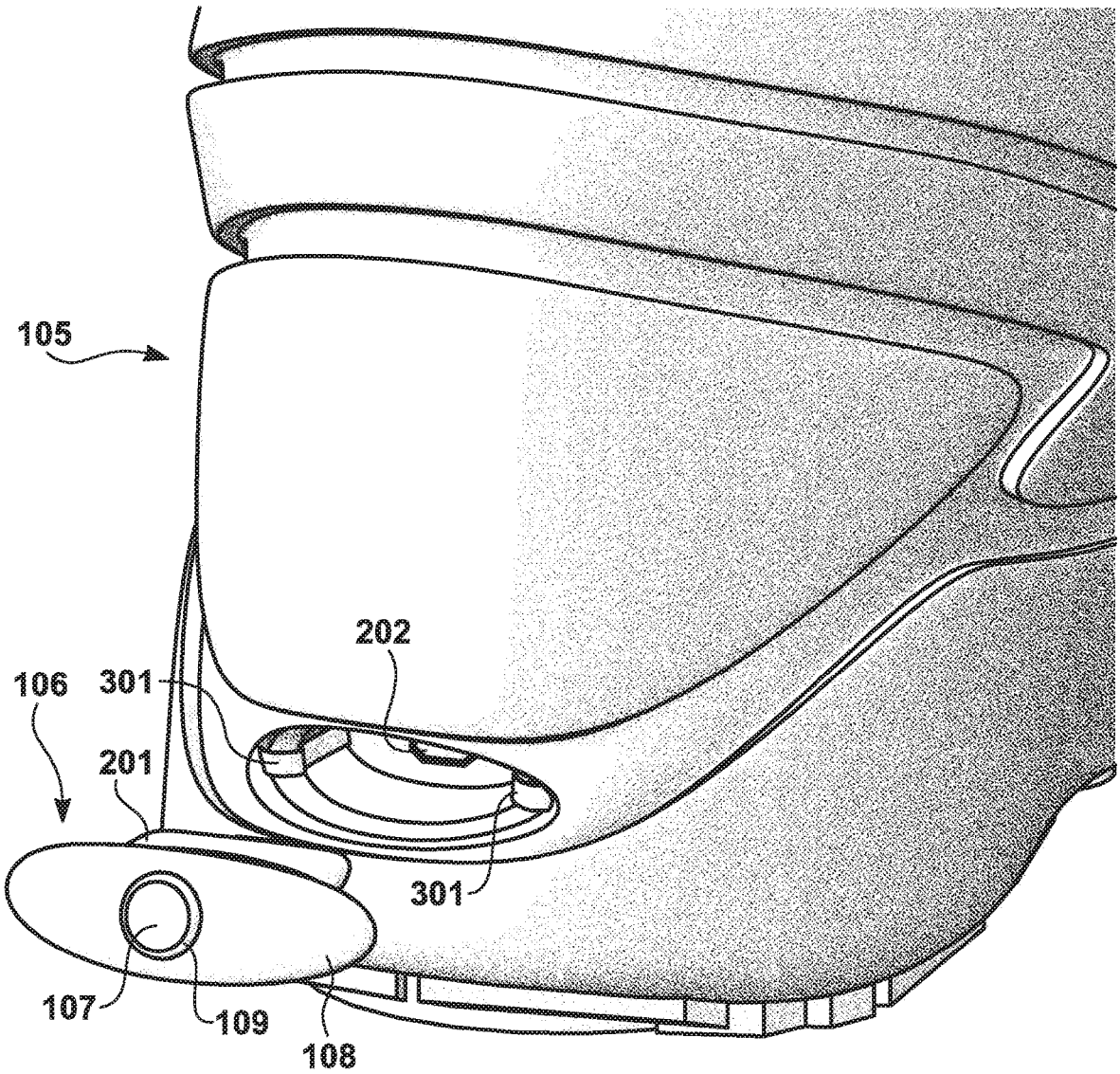
FIG. 3B illustrates an expanded view of the removable power supply assembly being disconnected from the internal connector positioned within the rear portion 105 of the footwear apparatus.
Figure 3C:
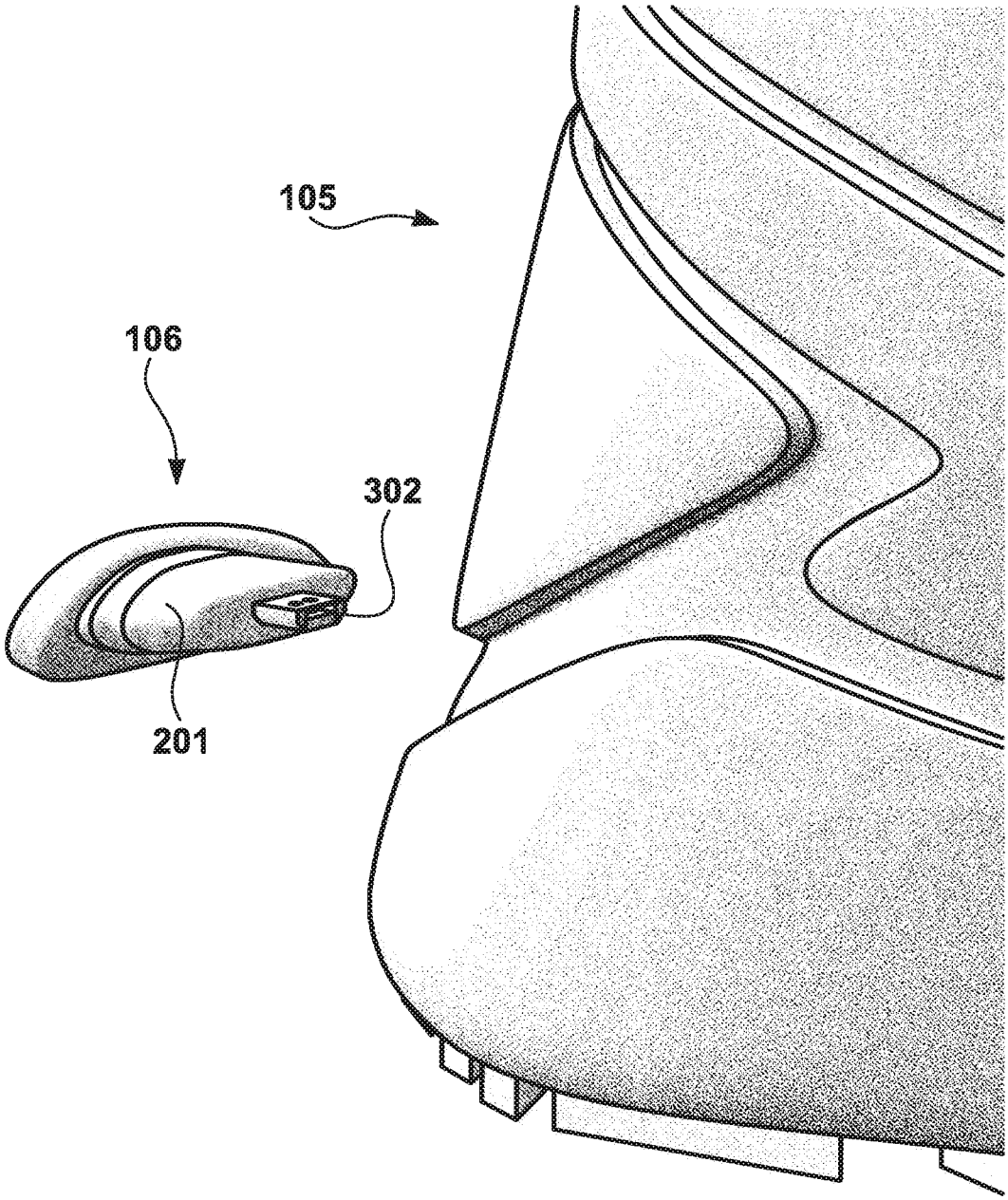
FIG. 3C illustrates an expanded view of the removable power supply assembly, with the integrated connector, being removed from the shoe, and ready for connection to an external electronics device.

Further, FIG. 3A illustrates an example of the internal removal system 300 for removing the removable power supply assembly 106 illustrated in FIGS. 1A-2B. The rear portion 105 may have an internal spring device 301 attached to an internal portion of the rear portion 105 (e.g., wall, pillar, etc.). Upon actuation of the exterior actuator 107, the internal spring device 301 ejects the removable power supply assembly 106 from the shoe 101. A connector 302 (e.g., USB) of the removable power supply assembly 106 may then be used to connect the removable power supply assembly 106 to an external electronics device. FIG. 3B illustrates an expanded view of the removable power supply assembly 106 being disconnected from the internal connector 202 positioned within the rear portion 105 of the footwear apparatus 100. Moreover, FIG. 3C illustrates an expanded view of the removable power supply assembly 106, with the integrated connector 302, being removed from the shoe 101, and ready for connection to an external electronics device.

Figure 3D:
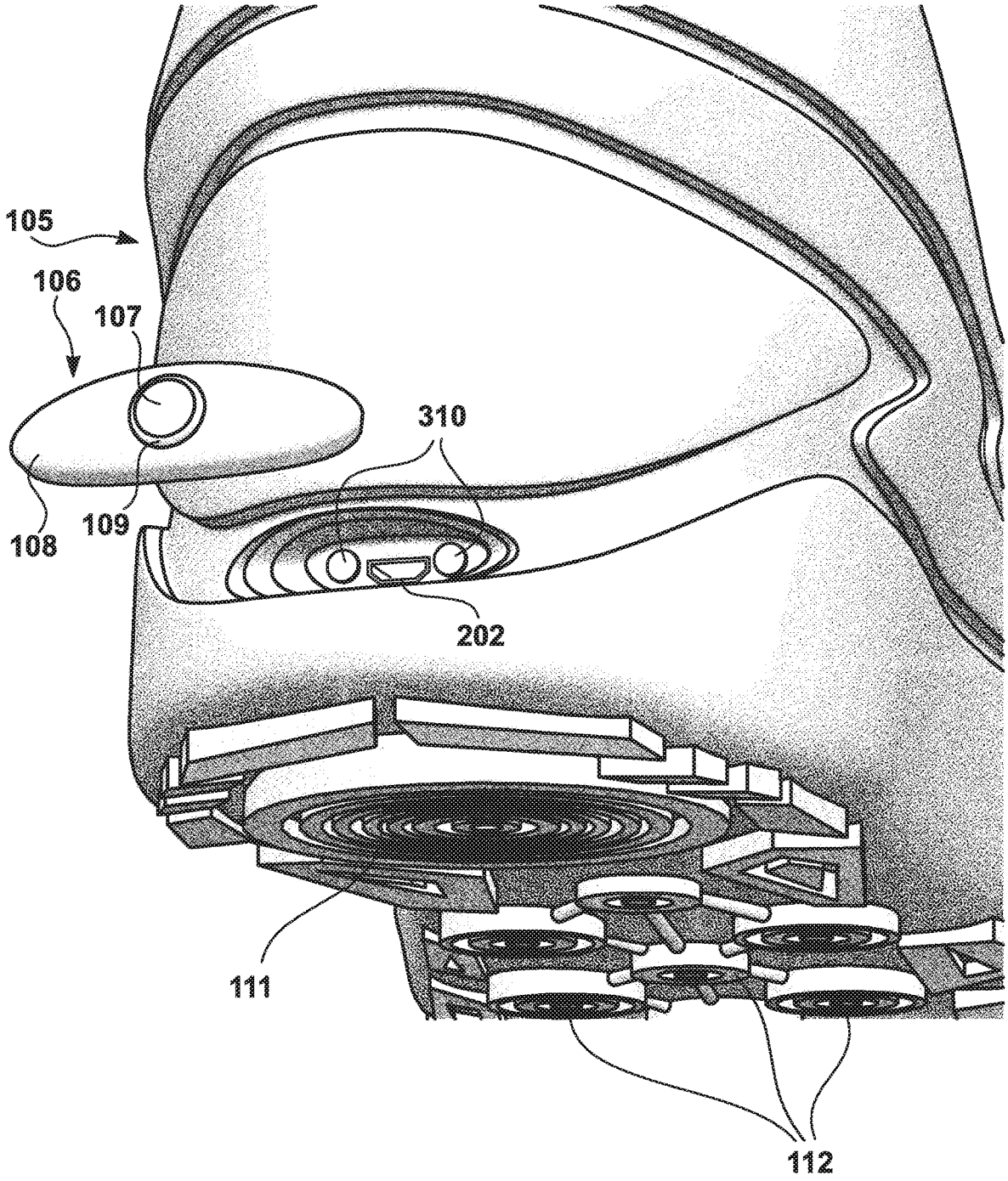
FIG. 3D illustrates another example of the internal removal system for removing the removable power supply assembly illustrated in FIGS. 1A-2B.

FIG. 3D illustrates another example of the internal removal system 300 for removing the removable power supply assembly 106 illustrated in FIGS. 1A-2B. The rear portion 105 may have a plurality of internal magnets 310 that adhere to a plurality of assembly magnets situated on the removable power supply assembly 106.

The examples of removal devices are illustrated only as examples. A variety of other removal devices, which may or may not include ejection mechanisms (e.g., bolt, screw, pin, etc.), may be utilized as alternatives.

Figure 4A:
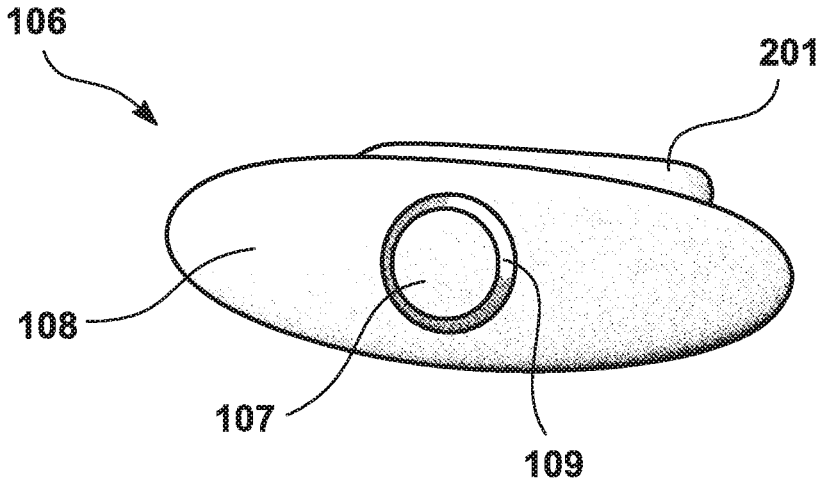
FIG. 4A illustrates a magnified, rear view of an example of the power level indicator situated at the rear portion of the shoe, which provides progressive illumination.

Additionally, FIG. 4A illustrates a magnified, rear view of an example of the power level indicator 109 situated at the rear portion 105 of the shoe 101, which provides progressive illumination. In one embodiment, the power level indicator 109 is illuminated (e.g., via LEDs) according to one or more increments (e.g., twenty five percent, fifty percent, seventy five percent, one hundred percent) situated in a circular, or substantially circular, formation around the exterior actuator 107. Accordingly, the power level indicator 109 may be powered by the removable power supply assembly 106 and may be configured to determine the electrical charge stored by the removable power supply assembly 106.

Although the power level indicator 109 is illustrated in the shape of a circle, the power level indicator 109 may take on a variety of other shapes (e.g., oval, triangle, square, rectangle, etc.). Alternatively, the power level indicator 109 may take on the shape of a brand indicium (e.g., company logo) associated with the manufacturer of the shoe 101. As yet another alternative, the power level indicator 109 may be one or more LEDs that does not take on any particular shape.

Figure 4B:
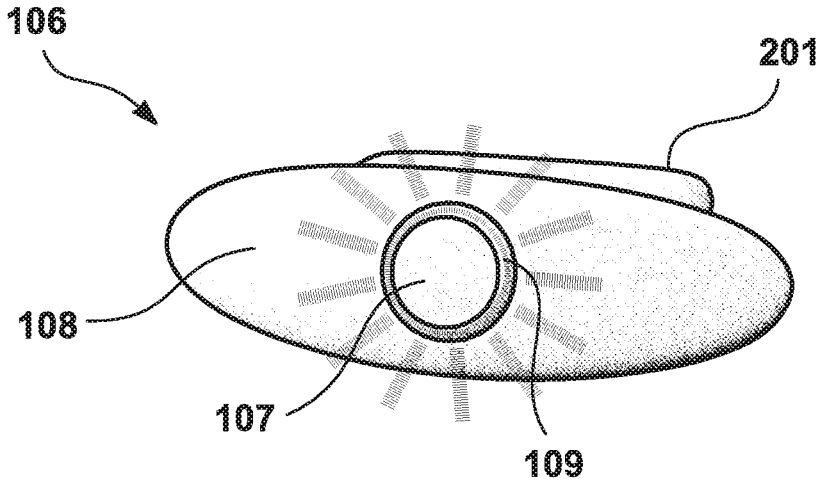
FIG. 4B illustrates a magnified, rear view of an example of the power level indicator situated at the rear portion of the shoe, which provides illumination based on adjustable intensity.

FIG. 4B illustrates a magnified, rear view of an example of the power level indicator 109 situated at the rear portion 105 of the shoe 101, which provides illumination based on adjustable intensity. The entire power level indicator 109

(e.g., may be illuminated, but may vary in its intensity. For example, the brightness of the entire circular ring may be adjusted from dim (i.e., low electrical charge stored by the rechargeable power supply 201) to bright (i.e., high electrical charge stored by the rechargeable power supply 201). As other examples, hue, contrast, and/or various other properties of light emitted by the power level indicator 109 may be adjusted based on the corresponding power level.

As an alternative, the power level indicator 109 may be situated on a section of the rear portion 105 that is distinct from the removable power supply assembly 106. For instance, the power level indicator 109 may be a linear plurality of LEDs situated within the rear portion 105, above the removable power supply assembly 106. Accordingly, even after the removable power supply assembly 106 is removed from the shoe 101, the power level indicator 109 may remain adhered to the shoe 101.

Although the power level indicator 109 is illustrated as being positioned at the rear of the shoe 101, the power level indicator 109 may be positioned on other parts of the shoe 101. For example, the power level indicator 109 may be positioned in proximity to the toe area of the top portion of the shoe 101. Accordingly, a user may have a direct view, while standing, of the current electrical power stored by the rechargeable battery 201 illustrated in FIG. 2.

Figure 5:
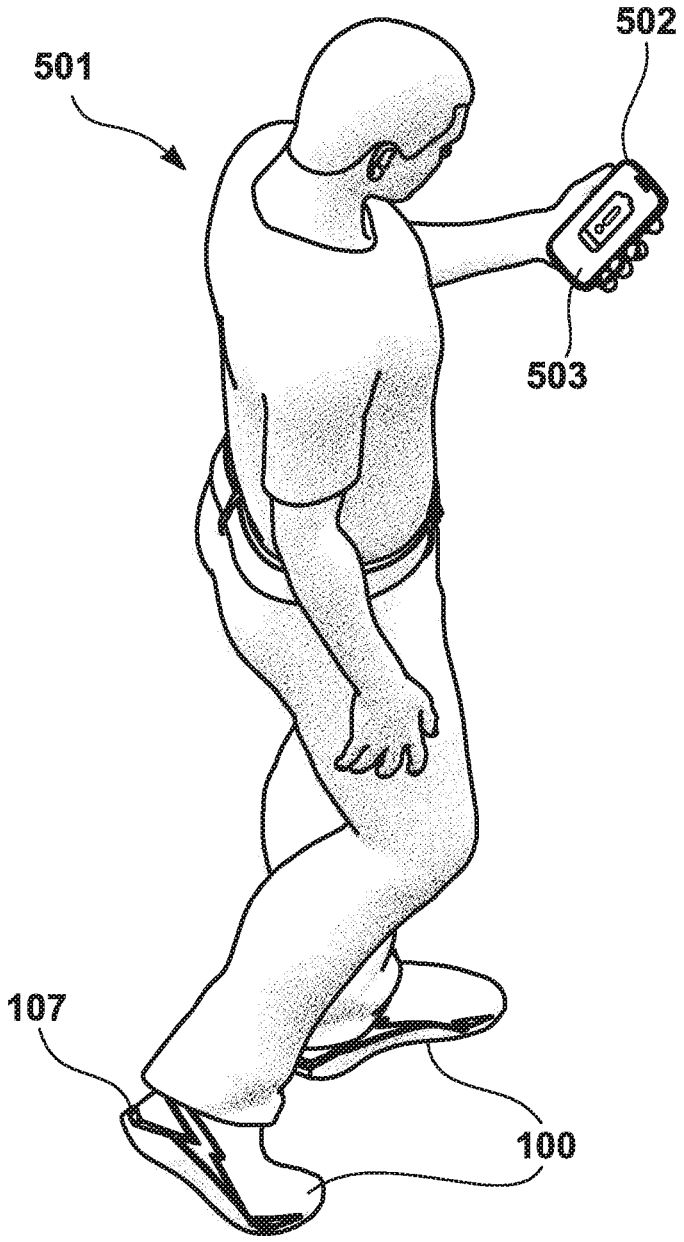
FIG. 5 illustrates a user that is wearing the footwear apparatus while also holding a smartphone.

Accordingly, a user may utilize the footwear apparatus 100 illustrated in FIGS. 1A-4C to generate electricity, during one or more physical activities, for charging an electronics device. For example, FIG. 5 illustrates a user 501 that is wearing the footwear apparatus 100 while also holding a smartphone 502. The screen display 503 of the smartphone 502 indicates that the smartphone 502 has a low battery level. Even though the user 501 may not be in proximity to a power outlet, the user 501 may utilize the footwear apparatus 501 to generate electricity to recharge the smartphone 502.

Figure 6A:
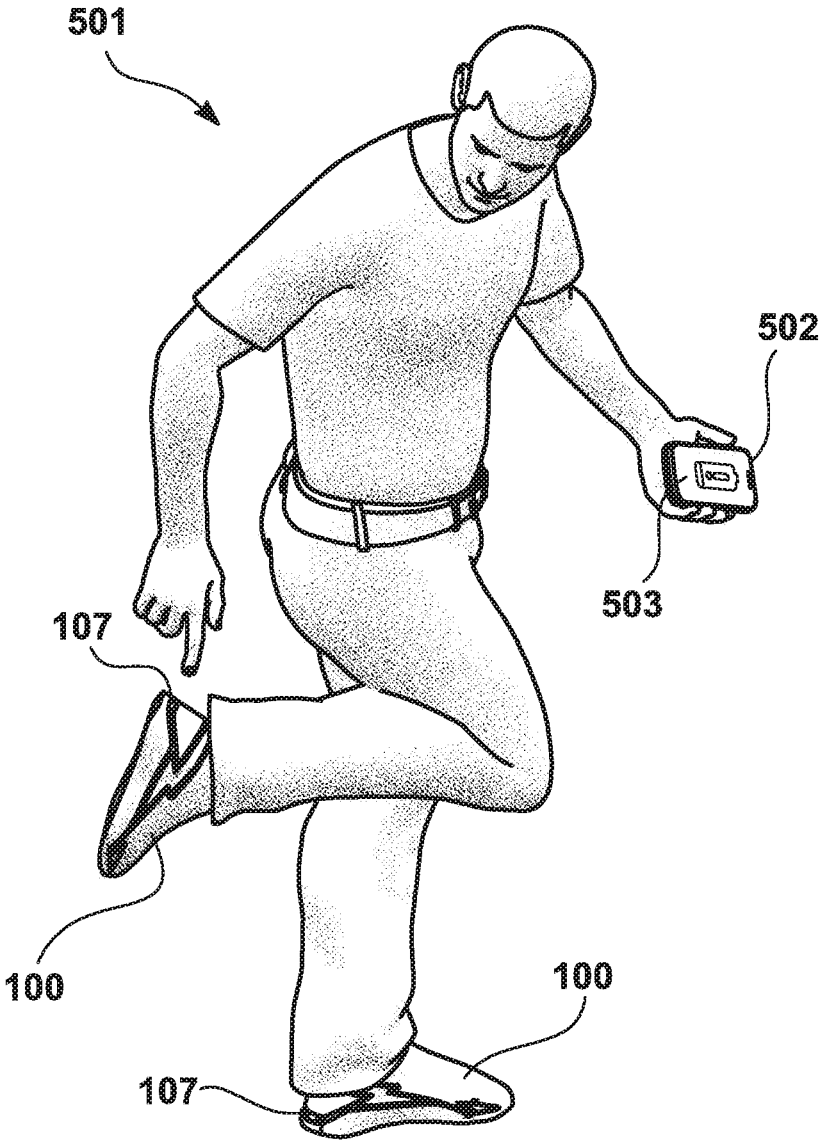
FIG. 6A illustrates the user illustrated in FIG. 5 sitting and viewing the power level indicator on the rear portion of the shoe to determine that a sufficient amount of electrical charge has been stored by the rechargeable battery for charging the battery of the smartphone.
Figure 6B:
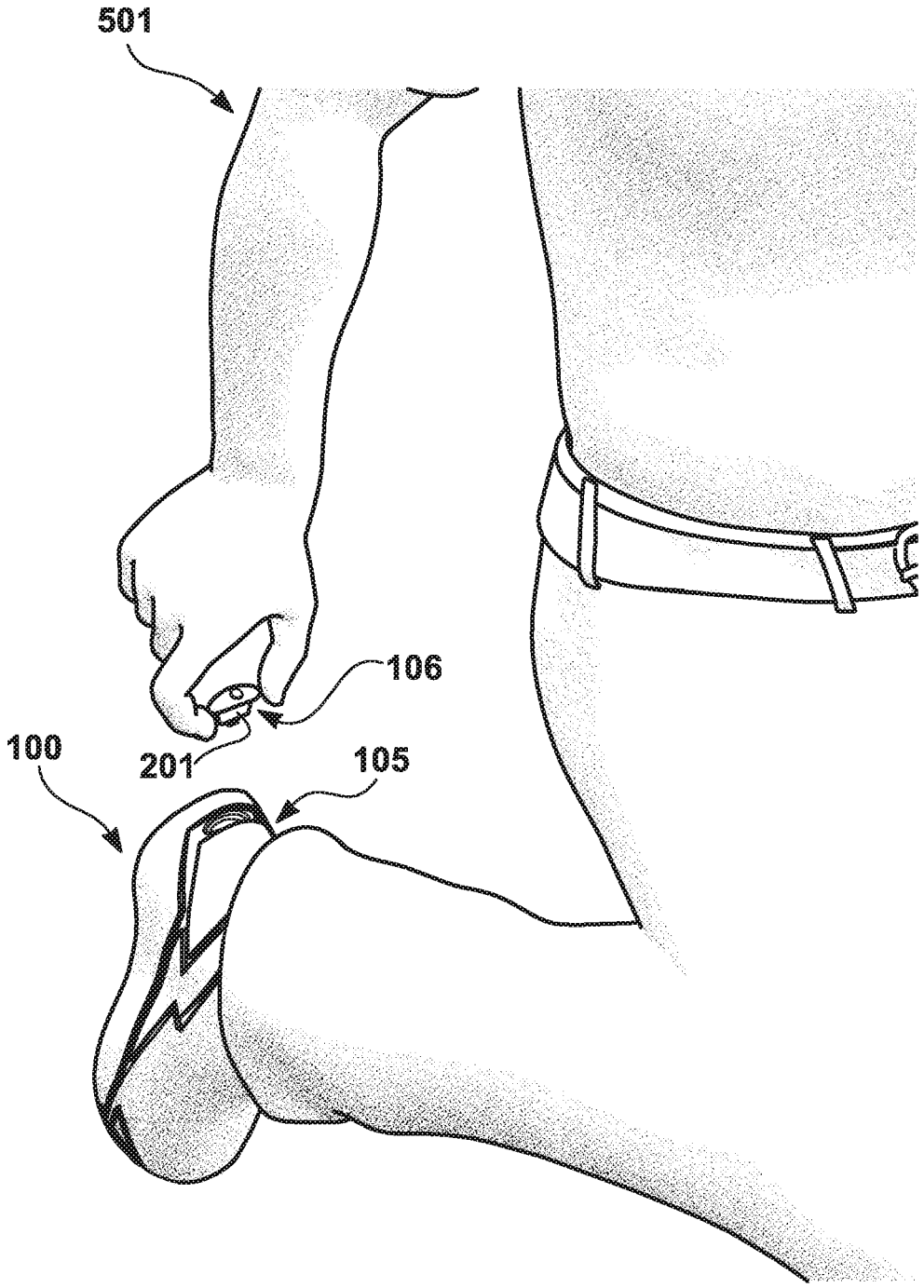
FIG. 6B illustrates the user 50 actuating the exterior actuator 107 (e.g., pressing a button) to eject the rechargeable power supply from the shoe 101.

FIG. 6A illustrates the user 501 illustrated in FIG. 5 turning to view the power level indicator 109 on the rear portion 105 of the shoe 101 to determine that a sufficient amount of electrical charge has been stored by the rechargeable power supply 201 for charging the battery of the smartphone 502. As illustrated in FIG. 6B, the user 501 may then actuate the exterior actuator 107 (e.g., press a button) to eject the rechargeable power supply 201 from the shoe 101.

Figure 7A:
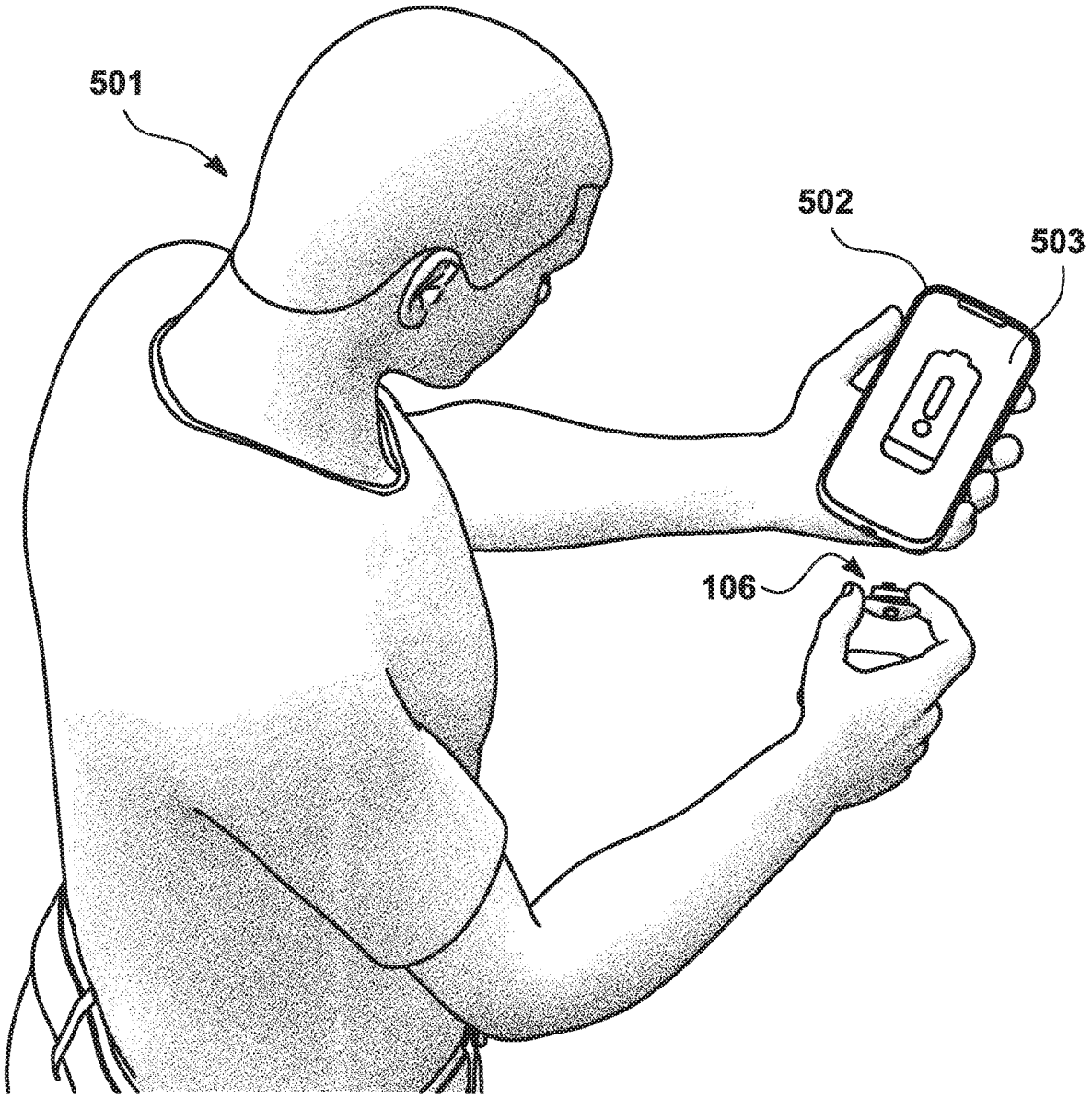
FIG. 7A illustrates the user connecting the rechargeable power supply to a receiving port of the smartphone to charge an internal battery of the smartphone.
Figure 7B:
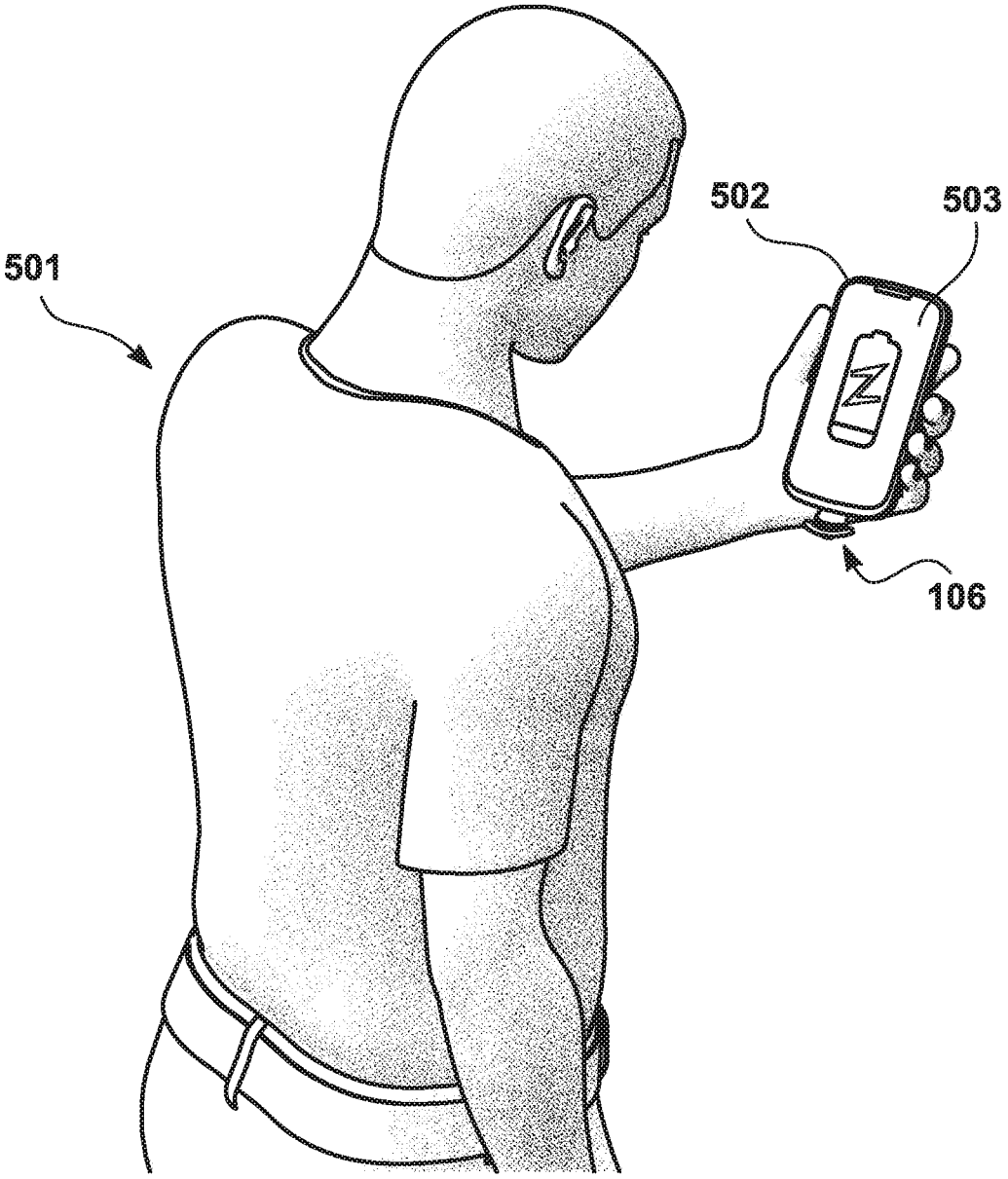
FIG. 7B illustrates the smartphone being charged as a result of the connected rechargeable power supply.

FIG. 7A illustrates the user 501 connecting the rechargeable power supply 201 to a receiving port 503 (e.g., USB port) of the smartphone 502 to charge an internal battery of the smartphone 502. Alternatively, the user 501 may utilize a different type of connection device (e.g., cable) to connect the rechargeable power supply 201 to the smartphone 502. As yet another alternative, the rechargeable power supply 201 may be used to wirelessly charge the internal battery of the smartphone 502 by placing the rechargeable power supply 201 in proximity to the smartphone 502. Further, FIG. 7B illustrates the smartphone 502 being charged as a result of the connected rechargeable power supply 201.

Figure 8A:
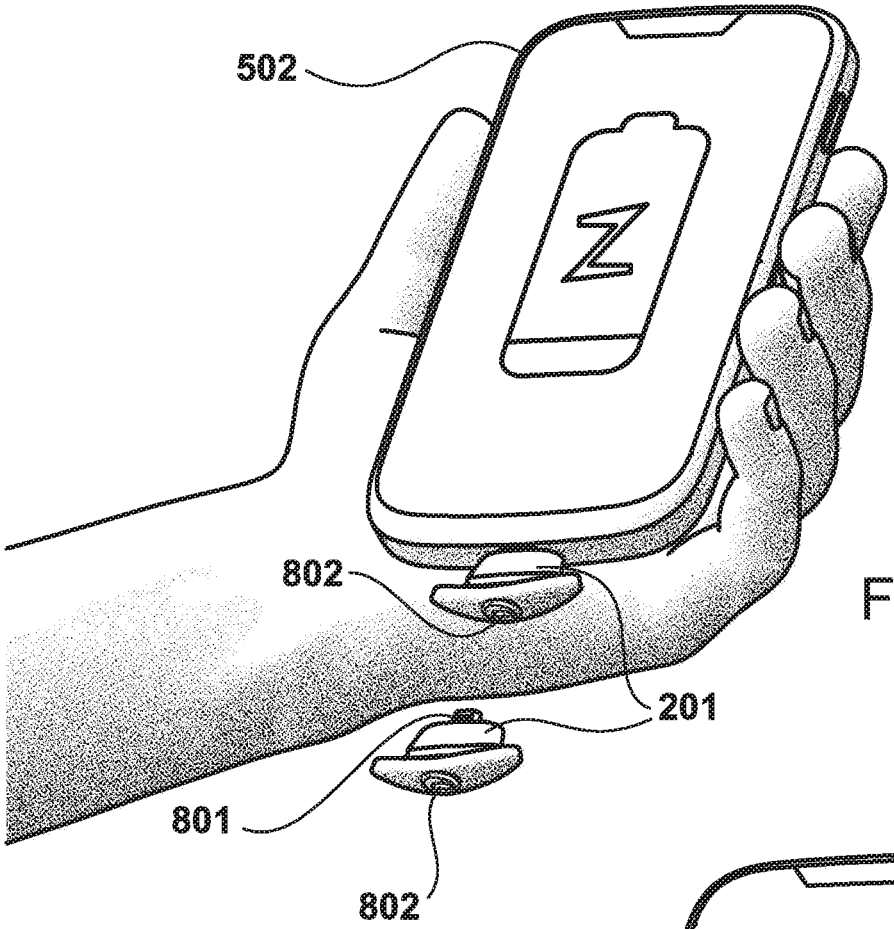
FIG. 8A illustrates a stackable configuration in which a left rechargeable power supply ejected from a left shoe and a right rechargeable power supply ejected from a right shoe are stackable.
Figure 8B:
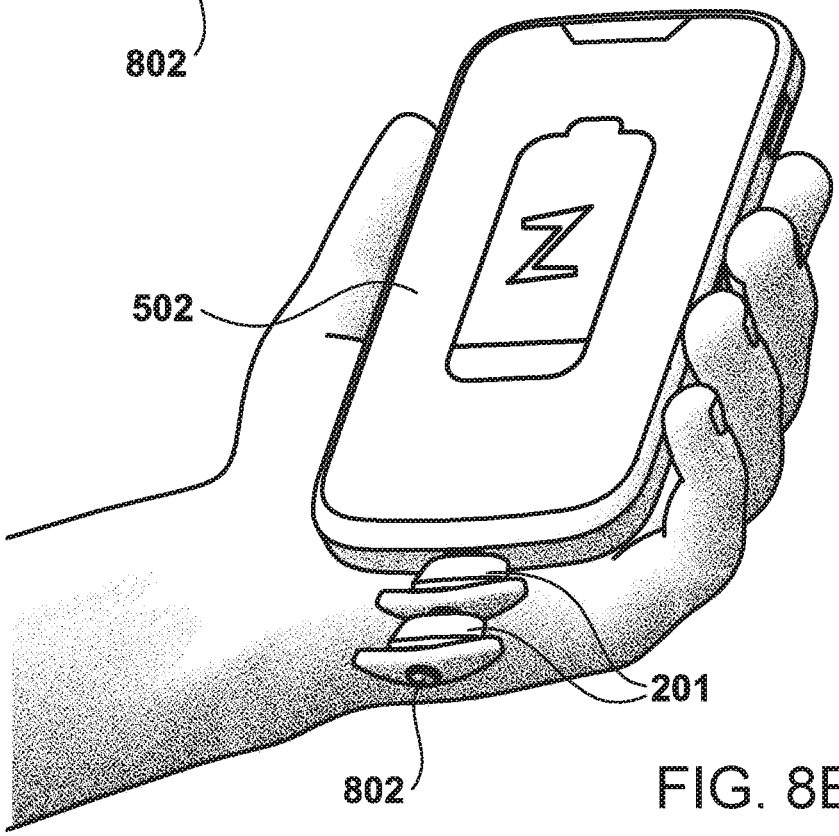
FIG. 8B illustrates, the user connecting the stacked rechargeable power supply to the receiving port of the smartphone.

Although the footwear apparatus 100 has been illustrated as one shoe, the footwear apparatus 100 may include both shoes in a pair. For example, both a right shoe 101 and a left shoe 101 may each have a rechargeable power supply 201. FIG. 8A illustrates a stackable configuration 800 in which a left rechargeable power supply 201 ejected from a left shoe 101 and a right rechargeable power supply 201 ejected from a right shoe 101 are stackable. In other words, a connector 801 and/or a receiver 802 may be situated on one, or both, of the rechargeable power supplies 201 to allow the rechargeable power supplies 201 to be connected to form a stacked rechargeable power supply 803. In one embodiment, the receiver 802 may be integrated within the actuation device 107. In another embodiment, the receiver 802 may be integrated within a different portion of the removable power supply assembly 106 other than the actuation device 107. FIG. 8B illustrates, the stacked rechargeable power supply 803 connected to the smartphone 502. As a result, the user may use the stacked rechargeable power supply 803 to provide twice the amount of electrical charge to the internal battery of the smartphone 502.

In conclusion, the footwear apparatus 100 illustrated in FIGS. 1A-8B provides an optimal arrangement of componentry that allows a user to maximize force-to-energy conversion for charging a removable battery that may be used to charge an external electronics device. The user is able to perform activities that accumulate electrical charge without sacrificing wearability or comfort.

The processes described herein may be implemented in a specialized, multi-purpose or single purpose processor. Such a processor will execute instructions, either at the assembly, compiled or machine-level, to perform the processes. A computer readable medium may be any medium capable of carrying those instructions and include a CD-ROM, DVD, magnetic or other optical disc, tape, silicon memory (e.g., removable, non-removable, volatile or non-volatile, packetized or non-packetized data through wireline or wireless transmissions locally or remotely through a network).

It is understood that the processes, systems, apparatuses, and compute program products described herein may also be applied in other types of processes, systems, apparatuses, and computer program products. Those skilled in the art will appreciate that the various adaptations and modifications of the embodiments of the processes, systems, apparatuses, and compute program products described herein may be configured without departing from the scope and spirit of the present processes and systems. Therefore, it is to be understood that, within the scope of the appended claims, the present processes, systems, apparatuses, and compute program products may be practiced other than as specifically described herein.

We claim:

1. A footwear apparatus comprising:

a bottom portion on which a foot of a user is positioned, the bottom portion having a heel portion and a toe portion;

a rear portion operably attached to the heel portion;

a force-to-energy conversion device that is operably attached to the heel portion in proximity to the rear portion, the force-to-energy conversion device receiving one or more external forces from an environment external to the shoe, the force-to-energy conversion device converting the one or more external forces to electrical energy; and a removable power supply assembly that is operably connected to the rear portion via an orifice at the rear portion, the removable power supply assembly comprising a power supply, a connection member, and an exterior actuator, the power supply storing the electrical energy, the connection member surrounding the exterior actuator, the connection member forming a sealant between the power supply and an external surface of the rear portion upon insertion of the removable power supply assembly into the orifice, the external actuator configured to remove the removable power supply assembly from the rear portion upon actuation.

2. The footwear apparatus of claim 1, wherein the removable power supply further comprises a power level indicator that surrounds at least a portion of the external actuator, the power level indicator indicating a power level of the power supply.

3. The footwear apparatus of claim 2, wherein the power level indicator comprises one or more illumination devices that provide progressive illumination corresponding to the power level of the power supply.

4. The footwear apparatus of claim 2, wherein the power level indicator comprises one or more illumination devices that adjust to a brightness intensity corresponding to the power level of the power supply.

5. The footwear apparatus of claim 1, further comprising a power level indicator that is operably attached to a static portion of the rear portion, the static portion being distinct from an external portion of the removable power supply assembly, the power level indicator indicating a power level of the power supply.

6. The footwear apparatus of claim 1, wherein the exterior actuator is an ejection button.

7. The footwear apparatus of claim 1, wherein the exterior actuator is a knob.

8. The footwear apparatus of claim 1, wherein the removable power supply assembly comprises a connector that connects to one or more additional removable power supply assemblies, via one or more receivers integrated within one or more corresponding exterior actuators of the one or more additional removable power supply assemblies, to amplify an amount of electrical charge provided to an external electronics device.

9. The footwear apparatus of claim 1, wherein the force-to-energy conversion device is a piezoelectric device.

10. The footwear apparatus of claim 1, further comprising a control system that composes data based on the one or more external forces.

11. The footwear apparatus of claim 10, further comprising a transmitter that transmits the data to an external electronics device.

12. The footwear apparatus of claim 11, further comprising a motion sensor that detects motion of the bottom portion, wherein the control system further composes the data based on the motion.

13. The footwear apparatus of claim 1, wherein the power supply has a connector that connects to an external electronics device to charge an internal battery of the external electronics device.

14. The footwear apparatus of claim 1, further comprising an outsole and a plurality of elevation members operably attached to the outsole, the outsole being operably attached to the bottom portion, the plurality of elevation members elevating the bottom portion to amplify the one or more external forces.

15. A footwear apparatus comprising:

a bottom portion on which a foot of a user is positioned, the bottom portion having a heel portion and a toe portion;

a rear portion operably attached to the heel portion;

a primary force-to-energy conversion device that is operably attached to the heel portion in proximity to the rear portion, the primary force-to-energy conversion device receiving one or more first external forces from an environment external to the heel portion, the primary force-to-energy conversion device converting the one or more first external forces to first electrical energy;

a removable power supply assembly that is operably connected to the rear portion, the removable power supply assembly comprising a power supply that stores the first electrical energy;

a secondary force-to-energy conversion device that is operably attached to the toe portion, the secondary force-to-energy conversion device receiving one or more second external forces from an environment external to the toe portion, the secondary force-to-energy conversion device converting the one or more second external forces to second electrical energy; and a removable power supply assembly that is operably connected to the rear portion via an orifice at the rear portion, the removable power supply assembly comprising a power supply, a connection member, and an exterior actuator, the power supply storing the electrical energy, the connection member surrounding the exterior actuator, the connection member forming a sealant between the power supply and an external surface of the rear portion upon insertion of the removable power supply assembly into the orifice, the external actuator configured to remove the removable power supply assembly from the rear portion upon actuation.

16. The footwear apparatus of claim 15, further comprising a control system that composes data based on the first one or more external forces and the second one or more external forces.

17. The footwear apparatus of claim 16, wherein the power supply provides electrical power to the control system.

18. The footwear apparatus of claim 15, wherein the primary force-to-energy conversion device is a first piezoelectric device, and the secondary force-to-energy conversion device is a second piezoelectric device.

19. The footwear apparatus of claim 15, wherein the removable power supply assembly comprises a connector that connects to one or more additional removable power supply assemblies, via one or more receivers integrated within one or more corresponding exterior actuators of the one or more additional removable power supply assemblies, to a amplify an amount of electrical charge provided to an external electronics device.

* * * * *